US009822965B1

(12) United States Patent
Jackson

(10) Patent No.: US 9,822,965 B1
(45) Date of Patent: Nov. 21, 2017

(54) MULTIPURPOSE HAND-HELD DEVICE AND ASSOCIATED SYSTEMS AND METHODS

(71) Applicant: James Kirk Jackson, Aspen, CO (US)

(72) Inventor: James Kirk Jackson, Aspen, CO (US)

( * ) Notice: Subject to any disclaimer, the term of this patent is extended or adjusted under 35 U.S.C. 154(b) by 403 days.

(21) Appl. No.: 14/510,924

(22) Filed: Oct. 9, 2014

Related U.S. Application Data

(60) Provisional application No. 61/890,015, filed on Oct. 11, 2013.

(51) Int. Cl.

| | |
|---|---|
| ***F04D 23/00*** | (2006.01) |
| ***F21V 33/00*** | (2006.01) |
| ***F21L 4/00*** | (2006.01) |
| ***F04D 25/08*** | (2006.01) |
| *F21Y 101/02* | (2006.01) |

(52) U.S. Cl.
CPC ..... *F21V 33/0096* (2013.01); *F04D 25/08* (2013.01); *F21L 4/00* (2013.01); *F21V 33/0076* (2013.01); *F21Y 2101/02* (2013.01)

(58) Field of Classification Search
CPC ..... F04D 25/08; F21L 4/00; F21V 33/0076; F21V 33/0095
See application file for complete search history.

(56) References Cited

U.S. PATENT DOCUMENTS

| | | | | |
|---|---|---|---|---|
| 3,099,386 | A | 7/1963 | Pieper | |
| 3,362,586 | A | 1/1968 | Dedoes | |
| 3,439,204 | A | 4/1969 | Ponczek et al. | |
| 3,792,230 | A | 2/1974 | Ray | |
| 3,809,504 | A | 5/1974 | Goossens | |
| 4,208,703 | A * | 6/1980 | Orr | F16M 11/38 362/109 |
| D275,328 | S | 8/1984 | Yin et al. | |
| 4,617,821 | A | 10/1986 | Yokoyama et al. | |
| 4,734,017 | A | 3/1988 | Levin | |
| 4,993,986 | A | 2/1991 | Bloomfield | |
| D322,844 | S * | 12/1991 | Leon, Jr. | D23/382 |
| D328,004 | S | 7/1992 | Baltic et al. | |
| D351,901 | S * | 10/1994 | Boruch | D23/328 |
| D414,550 | S | 9/1999 | Bloom | |
| 6,176,596 | B1 | 1/2001 | Shukla et al. | |
| 6,563,269 | B2 * | 5/2003 | Robinett et al. | H05B 33/0803 315/200 A |
| 6,579,062 | B2 * | 6/2003 | Lu | F04D 29/703 415/213.1 |

(Continued)

FOREIGN PATENT DOCUMENTS

| | | |
|---|---|---|
| CN | 201539704 | 8/2010 |
| CN | 201599581 | 10/2010 |

(Continued)

*Primary Examiner* — Woody Lee, Jr.
(74) *Attorney, Agent, or Firm* — Perkins Coie LLP

(57) ABSTRACT

A multipurpose, hand-held device comprises a focused light source and a ducted fan. The device produces and directs light and airflow, for the purpose of illuminating an area while starting and maintaining a fire. The airflow feature rapidly accelerates combustion. With the added safety and convenience of a hand-held, integrated flashlight, the device's controllable airflow delivers the capability to rapidly ignite and maintain fires made with charcoal, wood, coal, fire starters, paper, newspaper, cardboard, dung, etc.

20 Claims, 4 Drawing Sheets

(56) References Cited

U.S. PATENT DOCUMENTS

| | | | | |
|---|---|---|---|---|
| 7,513,633 | B2 * | 4/2009 | Ermeti | F21L 4/005 206/573 |
| D616,583 | S | 5/2010 | Bertken | |
| 7,845,820 | B2 | 12/2010 | Bertken | |
| D648,466 | S | 11/2011 | Hickman | |
| 8,113,682 | B2 | 2/2012 | Bertken | |
| 8,186,846 | B2 | 5/2012 | Bertken | |
| 8,348,465 | B2 | 1/2013 | Schrimmer et al. | |
| 8,360,596 | B2 | 1/2013 | Bertken | |
| D675,659 | S | 2/2013 | Yip et al. | |
| 8,529,087 | B2 | 9/2013 | Bertken | |
| 8,807,814 | B1 * | 8/2014 | Glenn | F21V 33/0096 2/171.3 |
| 2005/0239367 | A1 * | 10/2005 | Fernandez, Jr. | A23G 3/563 446/73 |
| 2011/0121727 | A1 * | 5/2011 | Sharrah et al. | F21L 4/00 315/32 |

FOREIGN PATENT DOCUMENTS

| | | |
|---|---|---|
| CN | 201753838 | 3/2011 |
| JP | 2005337217 | 12/2005 |
| WO | WO 2010/135891 | 12/2010 |

* cited by examiner

MULTIPURPOSE HAND-HELD DEVICE AND ASSOCIATED SYSTEMS AND METHODS

CROSS-REFERENCE TO RELATED APPLICATION(S)

The present application claims priority to and the benefit of U.S. Provisional Application No. 61/890,015, filed Oct. 11, 2013, which is incorporated by reference in its entirety.

TECHNICAL FIELD

The present technology relates generally to multipurpose hand-held devices, and more specifically to integrated hand-held devices for providing light and airflow and associated systems and methods.

BACKGROUND

Starting and maintaining a fire safely and quickly can be difficult in certain situations. Factors for starting and maintaining a fire can include visibility and climatic conditions (e.g., wind, temperature, humidity, altitude, etc.).

Generally, existing airflow devices such as manual or electric bellows, fans, etc., may be large and cumbersome. For example, a portable fan can be impractical, inconvenient, and slow in starting and maintaining a wide variety of fires including charcoal/wood BBQ, in a fireplace, wood stove, campfire, cooking grates, etc. Such existing devices may require power (e.g., from an external source) and do not have an integrated light source. In order to provide light and airflow simultaneously, two separate devices may be necessary. A user may need to manage the two separate devices at the same time as he or she is trying to light and maintain a fire which may result in needless distractions and possibly be a safety hazard. Additionally, separate devices may require the use of both hands or potentially the need for assistance from another person.

DETAILED DESCRIPTION

Figure 1A:
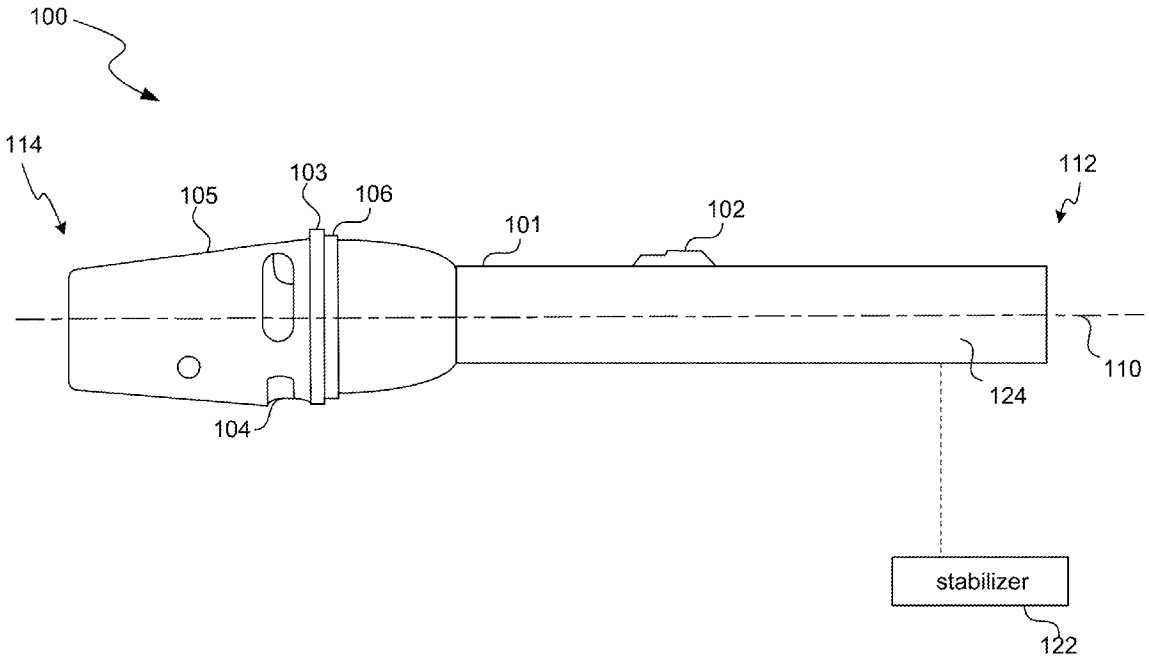
FIG. 1A is a partial side isometric view of a multipurpose hand-held device configured in accordance with an embodiment of the present technology.
Figure 1B:
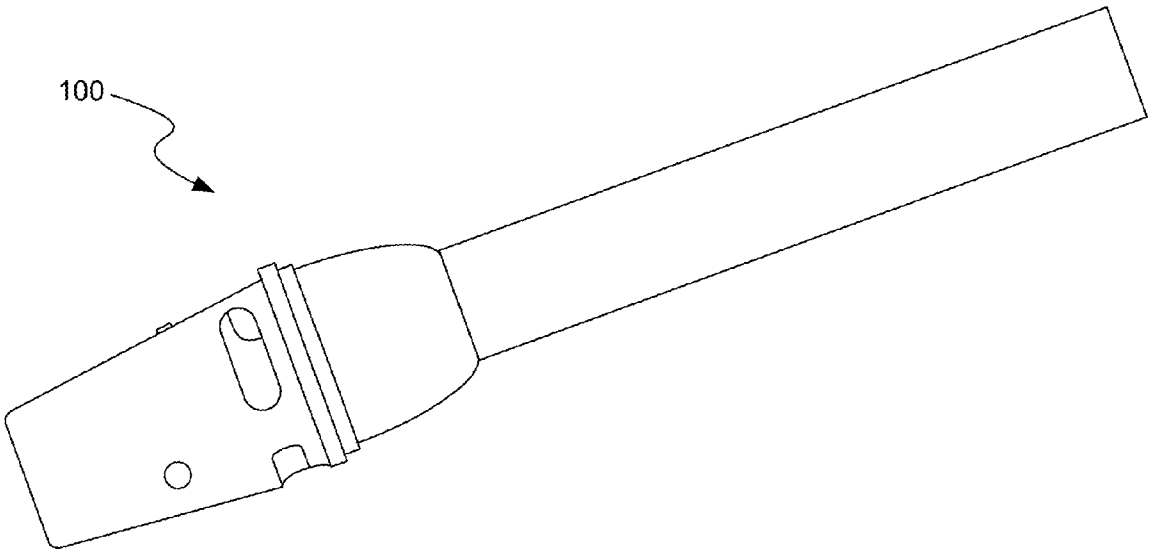
FIG. 1B is a perspective view of the multipurpose hand-held device of FIG. 1 configured in accordance with an embodiment of the present technology.

The present technology describes various embodiments of multipurpose hand-held devices for providing light and airflow and associated systems and methods. In several embodiments, for example, a multipurpose hand-held device can include an integrated focused light source, ducted fan, and a power source for supplying power to the light source and ducted fan. Such devices as described herein can provide sustained (sometimes referred to as continuous) airflow and light resulting in a convenient and safe method to start and maintain a fire quickly. These devices can be considerably safer and more effective than existing alternatives such as blowing on a fire in the dark. Any of the embodiments described herein provide a unique design and can be highly durable, reliable, heat resistant and/or safe to use. The selection of materials/components for the device can incorporate a compact, ergonomic, and user friendly design, in an assembly of functionally reliable and purposeful components which can result in cost effective production and manufacturing.

A multipurpose hand-held device according to the present technology can produce and direct light and airflow for illuminating an area while starting and maintaining a fire. For example, embodiments of the present technology can provide: 1. Supplemental oxygen via directed, focused, and controllable airflow and 2. Light to enhance visibility and safety. The airflow can rapidly accelerate combustion (e.g., of fuels requiring oxygen) to start and maintain the fire. The rate of combustion may be rapidly increased, observed, and managed safely with the device as described herein by controlling the flow of air to the combustion site.

With the added safety and convenience of a hand-held, integrated flashlight or other light source, the device's airflow (e.g., controllable) delivers the capability to rapidly ignite and maintain fires (e.g., made with charcoal, wood, coal, fire starters, paper, newspaper, cardboard, dung, etc.). Further, creating a signal fire quickly can save lives, especially in an emergency situation when time is of the essence.

According to certain embodiments, the multipurpose hand-held device can use battery power to operate both a light source and a small fan. The power control scheme may allow either simultaneous and/or independent operation of both the light source and the small fan allowing, for example, the device to be used as a flashlight if necessary without powering the fan or as a controllable air source when light is not required, such as during the day. In low or no light conditions, this allows a user to see combustible fuels prior to ignition, which allows the user to safely ignite a fire on the combustible fuel. Once combustion has begun, the integrated fan can provide airflow (e.g., additional oxygen) to quickly accelerate fuel burn. Additionally, the airflow can revive a waning/smoldering fire prior to or while adding more fuel.

Steps of an exemplary method for using the device (e.g., in low or no-light conditions) include: a user turning on the lighting feature of the device to illuminate a fuel to be ignited or area where a fire is to be started. Once ignited, and satisfactory ignition is achieved, the fan can be turned on and directed at the fire to accelerate combustion.

Certain details are set forth in the following description and in FIGS. 1A-1D to provide a thorough understanding of various embodiments of the present technology. For example, several embodiments of the multipurpose hand-held device are described below in the context of starting and maintaining fires. However, the multipurpose hand-held device and aspects thereof disclosed herein may be used in a wide variety of other contexts including, but not limited to: medical situations where drying or curing adhesives may be required, cooling of electrical components, overheated tools, etc., and thawing and de-icing frozen door locks, cold hands, or other mechanisms. Other details describing well-known structures and systems often associated with fans, flashlights or other light sources, power sources, circuitry, switches, etc., have not been set forth below to avoid unnecessarily obscuring the description of the various embodiments of the present technology.

Many of the details, dimensions, angles, airflow, power, light output and other features shown in FIGS. 1A-1D are merely illustrative of particular embodiments of the present technology. Accordingly, other embodiments can include other details, dimensions, angles, airflow, power, light output and features without departing from the spirit or scope of the present invention. In addition, those of ordinary skill in the art will appreciate that further embodiments of the multipurpose hand-held devices can be practiced without several of the details described below.

In the Figures, identical reference numbers identify identical or at least generally similar elements. To facilitate the discussion of any particular element, the most significant digit or digits of any reference number refers to the Figure in which that element is first introduced. For example, element 110 is first introduced and discussed with reference to FIG. 1A.

FIG. 1A is a side isometric view of a multipurpose hand-held device 100 ("hand-held device 100" or "device 100") configured in accordance with an embodiment of the present technology. In the illustrated embodiment, a central longitudinal axis 110 extends axially between a proximal end 112 and a distal end 114 of the hand-held device 100. In one aspect of the illustrated embodiment, the hand-held device 100 includes one or more components including a handle enclosure 106 (e.g., housing, body, shell, handle), a light source 103, vented ducting 104, electric fan 105, multi-function switch(s) 102, and batteries 101.

In some embodiments, one or more components of the hand-held device 100 are integrally or monolithically formed as one or more units. For example, the handle enclosure 106 (e.g., a user can grip or hold the device with) can be integrally formed with the vented ducting 104 and/or the handle enclosure 106 can be integrally formed with the light source 103, such as in a flashlight. In the illustrated embodiments, one or more components of the hand-held device 100 are separate components which are then integrated (e.g., assembled or operably coupled together). For example, the vented ducting 104 can be attached or mounted to a distal end of the handle enclosure 106 (e.g., with suitable fasteners as described herein).

In one aspect of the illustrated embodiment, the handle enclosure 106 extends from the proximal end 112 of the device towards the distal end 114 along the longitudinal axis 110. The handle enclosure 106 can be a flashlight in certain embodiments having the light source 103 positioned at a distal end or base of the handle enclosure 106 with the vented ducting 104 being coupled (e.g., mounted, attached) to the distal end of the handle enclosure 106. However, in other embodiments, the light source 103 and/or additional lights can be positioned in various other locations including the distal end or base of the handle enclosure 106. As shown in FIG. 1A, the distal end of the handle enclosure 106 flares slightly at the end, but the flare is optional. Generally, the device 100 is designed for balance, and the flare may be incorporated or not to balance the device 100 in a natural one-handed grip.

The handle enclosure 106 can be or form a portion of a flashlight. In certain embodiments, a heavy duty style policeman flashlight (e.g., a Maglite™) can be used. However, in other embodiments, different styles or manufacturers can be used with various sizes, weights, lights, materials (e.g., plastic, brushed aluminum, steel), etc. Therefore, the weight of the device 100 can be reduced depending on the type of flashlight or materials used. Additionally, light output and power can be optimized. Further, different materials can be used for different environments, e.g., shock resistant, a water-resistant or proof material for rainy conditions. In certain embodiments, the handle enclosure 106 has a length of about 10 inches and a handle diameter of about 1.5 inches. However, the handle enclosure 106 can be sized with various lengths and diameters accordingly. Thus, while the handle enclosure 106 has been found to provide a compact and balanced cylindrical device 100 for one-handed grip/operation, the handle enclosure 106 may take other shapes such as shorter or squarer.

The handle enclosure 106 can include one or more of any of the following features and components. The handle enclosure 106 may include an adjustable tripod stabilizer 122 or stand as schematically illustrated. The stabilizer 122 can be used to prop the hand-held device 100 up when not in use or if hands-free lighting and/or airflow is desired. The stabilizer 122 can be retracted or foldable for portability and/or storage. In some embodiments, the stabilizer 122 along with other accessories (e.g., lighter, matches, pocket knife) can be stored in a storage compartment 124 located within (e.g., a proximal end of) the hand enclosure 106. In some embodiments, the storage compartment 124 is an existing hollowed out portion of the hand enclosure 106 (e.g., such as an entire or a portion of a battery compartment). In such embodiments, the location of the batteries can be moved to another position within or outside of the hand enclosure 106. In some embodiments, the hand-held device is powered by another source or supply (e.g., solar-powered, fuel cells, etc.) such that the battery compartment is not necessary, but the handle enclosure 106 may still have a hollowed portion for storage.

The light source or sources 103 for illuminating an area or combustion product (e.g., for starting or maintaining a fire) can be positioned behind or forward of the electrical fan 105 (e.g., upstream and/or downstream) relative to the longitudinal axis 110. The light source 103 can be positioned on interior or exterior surfaces of the vented ducting 104 and/or any portion of the handle enclosure 106. In certain embodiments, light sources 103 positioned downstream of the fan 105 or other blower can provide improved light output and/or illumination relative to an identical light sources 103 located upstream of the fan 105 (e.g., the fan 105 may cause a shadowing effect reducing illumination). The light source 103 may be any combination of one or more LED lights, SOS safety lights (e.g., blinking lights), strobe lights, colored glow lights, halogen bulbs, incandescent bulbs, laser, etc. In some embodiments, the internal surface of the vented ducting may be mirrored or reflective to increase the light output.

The light source 103 is operably coupled to (e.g., in electrical communication with, connected in an electrical circuit to) the batteries 101 (e.g., or other type of power source) and the switch 102. The switch 102 is operable to provide power to the light source and user control of the power to the light source 103 (e.g., on, off, light output). In certain embodiments, the switch 102 may incorporate a variable resistance or rheostat to allow the intensity of the light from the light source 103 to be controllable by the user. Certain types of lower power light sources 103, such as LEDs, can be used to decrease the necessary power draw or requirements to improve the life of the batteries 101 or other power source. In certain embodiments, the one or more light sources 103 can provide about 10 lumens or less of light output. In some embodiments, about 10 to 50 lumens can be provided. In certain embodiments, about 50 to 100 lumens can be provided. In other embodiments, about greater than 100 lumens can be provided. The light from the light source 103 is generally targeted to an area where the airflow from the fan 105 is directed, which can aid in starting a fire safely (e.g., in low or no-light conditions).

Figure 1C:
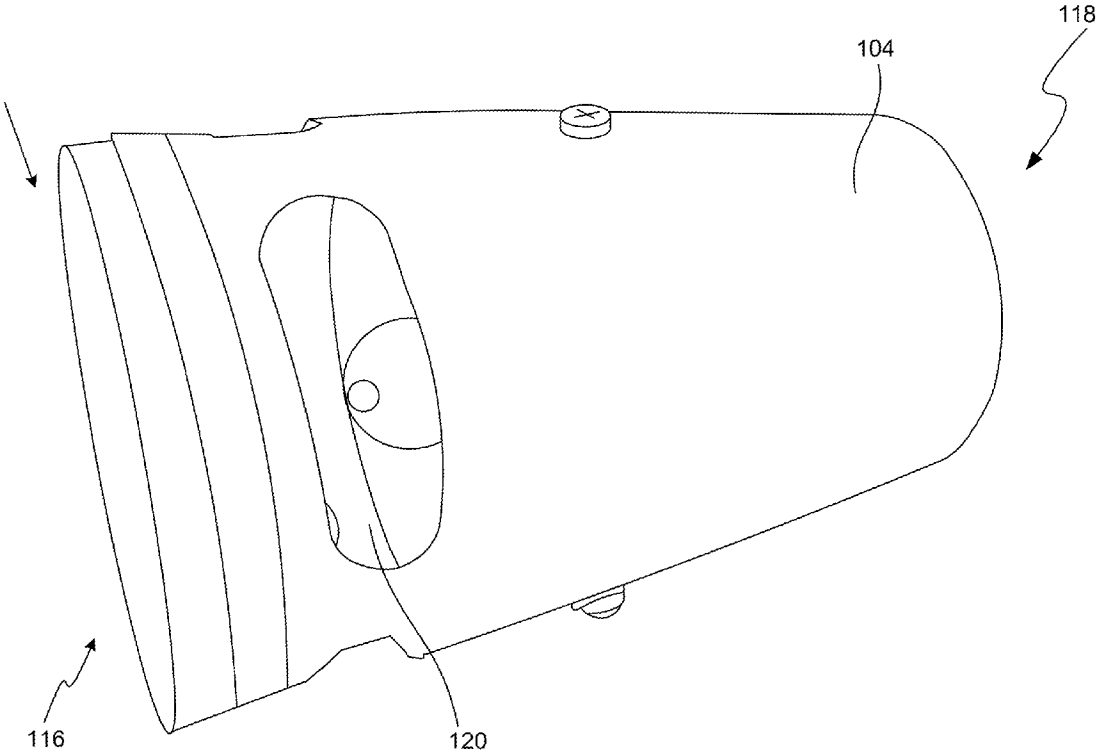
FIG. 1C is a partial side isometric view of certain components including a ducting of a multipurpose hand-held device configured in accordance with an embodiment of the present technology.

As illustrated in FIGS. 1A and 1C, in certain embodiments, the vented ducting 104 is coupled to the distal end of the handle enclosure 106. The vented ducting 104 can have a generally conical (or frustoconical) configuration with first and second openings 116, 118 at opposing ends of the vented ducting 104. The first or proximal opening 116 is sized to fit over a distal end of the handle enclosure 106 (e.g., with a friction fit to a bezel of the handle enclosure 106 or flashlight). The second or distal opening 118 allows airflow generated by the electric fan 105 to be released and directed as desired by the user (e.g., depending on an angle or position the user is holding the hand-held device 100). As illustrated, the first opening 116 is larger in diameter than the second opening 118. However, in other embodiments, the opposite can be true or the openings can be similar or equivalent in size.

In other embodiments, the vented ducting 104 can be attached or coupled to the hand enclosure 106 with other or additional suitable fastening techniques and/or feature. For example, the friction fit between the vented ducting 104 and the hand enclosure 106 can be increased by using a cable-tie, zip-tie, rubber band, elastic tether or the like. The vented ducting 104 can be threaded onto the handle enclosure 106, coupled with a snap-fit configuration, or integrally formed with the hand enclosure 106. In some embodiments, an adhesive (e.g., glue, weld, velcro, etc.) can be used to attach the vented ducting 104 to the hand enclosure 106. Other suitable fasteners (e.g., screws, pins, bolts) can be used in addition to or separately from the fastening techniques described above to couple the vented ducting 104 to the hand enclosure 106.

The vented ducting 104 can include one or more vents 120 or intake ducts (e.g., positioned upstream of the electric fan 105). As illustrated, the vents 120 can extend radially or circumferentially about a proximal end of the vented ducting 104 adjacent the distal end of the hand enclosure 106. The vents 120 are sized sufficiently and/or number of vents to provide the necessary airflow. For example, the vents 120 are sized (e.g., having an area greater than equal to 3 square inches) to allow the fan to produce an airflow of 2-6 liters/second out the second opening 118 of the ducting 104 for (e.g., starting and maintaining a fire). In other embodiments, the vents 120 have an area greater than equal to 2 square inches, or 3 square inches, or 4 square inches, or 5 square inches, or 6 square inches, or 7 square inches, or 8 square inches, and/or any value therebetween. Intake air is directed through the one or more vents 120 to the electric fan 105 positioned within the vented ducting 104 between the first and second openings 116, 118 downstream of the one or more vents 120. The vents 120 can have any suitable configuration including rectangular, oval, etc.

In certain embodiments, one or more filters 126 (e.g., protective screen mesh, filter cloth, etc.) can be positioned on or over the one or more vents 120 to prevent debris from entering and harming the fan (e.g., fan blades). In some embodiments, the vented ducting 104 includes a protective end cap (sufficiently perforated) and/or screen mesh downstream of the fan 105 (e.g., positioned over second opening 118). In some embodiments, the vented ducting 104 includes one or more vanes to control or direct airflow through the ducting. In other embodiments, the vented ducting 104 can include an integrated lighter (e.g., a heating element, glow plug, resistive element, piezo-electric gas lighter, etc.) that is both deployable and controllable by a user. In some embodiments, the integrated lighter (or heater) may be used to warm the air flowing from the device 100's second opening 118. Warming the air may facilitate de-icing, hand warming, or curing of components in certain situations, such as, for example, warming hands in frostbite conditions. In the alternative, the device 100 may be used to cool overheated components by blowing unheated air over the components, such as, for example, a radiator, an electronic device, a tool, or the like.

As illustrated, the vented ducting 104 can be made from a plastic (e.g., used in producing marshaling wands) or other suitable material that is heat and/or flame resistant. In some embodiments, the vented ducting 104 can be directly cut or shaped from an existing marshaling wand (e.g., used to direct airplanes). In certain embodiments, the vented ducting 104 is formed with a photo-luminescent material such that the vented ducting 104 can "glow-in-the-dark." Such a photo-luminescence features can provide potential additional light output and make it easier to find the device 100 or a user with the device 100 in the dark.

Figure 1D:
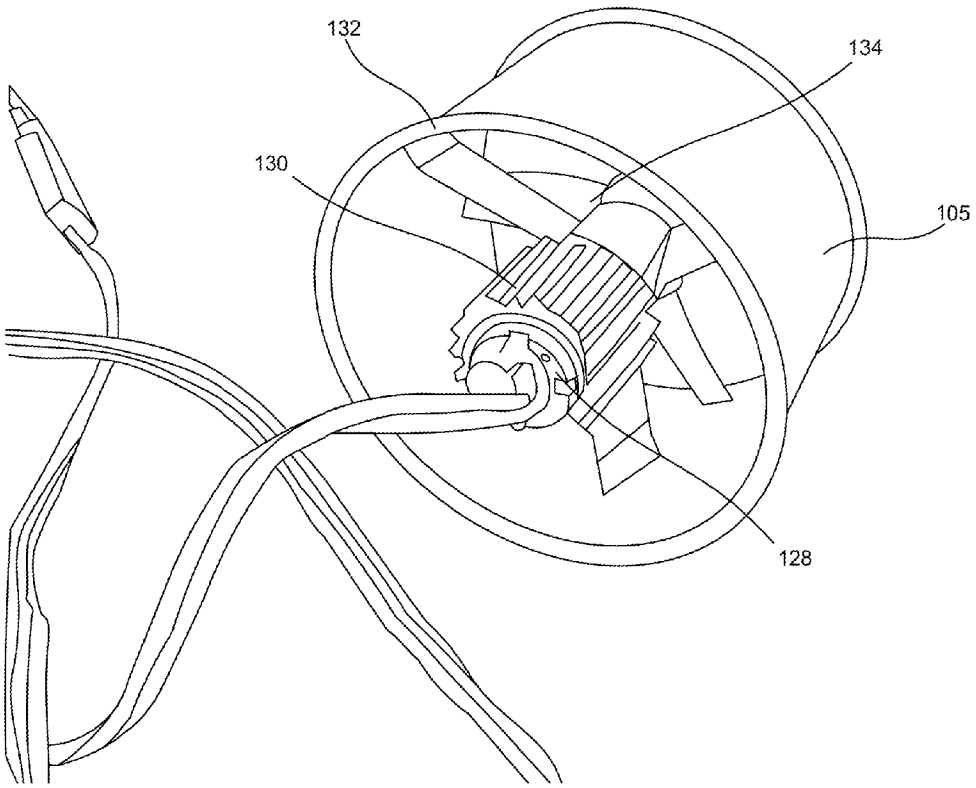
FIG. 1D is a partial side isometric view of certain components including a fan of a multipurpose hand-held device configured in accordance with an embodiment of the present technology.

As illustrated in FIGS. 1A and 1D, the electric fan 105 (e.g., or other type of blower) for providing airflow (e.g., additional oxygen) for starting and maintaining a fire can be mounted in the vented ducting 104 distal relatively to the one or more vents 120. As illustrated in FIG. 1D, the fan 105 includes a motor 128, heat sink 130, duct 132, and impeller 134. The fan 105 is attached to the ducting with one or more screws 136. However, in other embodiments, other suitable fastening techniques can be used to secure the fan 105 to the ducting 104 including welds, tongue and groove, rivets. As described above, the fan 105 can provide sufficient airflow from about 2-6 liters/second for starting and maintaining a fire efficiently. However, in other embodiments, the fan 105 can provide at less than equal to about 8, or 10, or 12, or 14, or 16, or 18, or 20 and/or any value therebetween of liters/second airflow.

The electric fan 105 is powered by the motor 128 which is electrically coupled to the switch 102 and batteries 101 (or other power source). The motor 128 can be a brushless motor with electronic speed control. In some embodiments, the motor 128 is a brushed motor. The motor can be sized to provide sufficient power to the fan 105 but with relatively low power requirements such that the device 100 can last as long as possible. In certain embodiments, the motor 128 is a single speed motor. In other embodiments, the motor 128 is a variable speed motor where the speed of the motor, and the air flow, is controllable between 0% and 100% of full flow.

The hand-held device 100 is provided with one or more switches 102 for controlling the power to the light source 103 and electric fan 105. Such a switch can be a single two-way (e.g., two position) on/off switch as illustrated in FIG. 1A. The light source 103 and electric fan 105 can both be wired to the switch 102 (e.g., push-button) carried by the hand enclosure 106 (e.g., as in an existing flashlight). In a first position (e.g., on position), both the light source 103 and fan 105 (e.g., or other blower) are on simultaneously. In a second position (e.g., off position), both the light source 103 and fan 105 are off simultaneously. In certain embodiments, the hand-held device 100 is provided with multiple switches 102 for controlling different functions independently. For example, the fan 105 and light source 103 can be wired to two different switches. In some embodiments, the device 100 can be provided with a remote switch 102 allowing a user to control the functionality of the device from a remote position.

In some embodiments, the switch 102 is a multi-functional or purpose switch having multiple positions to allow a user to, for example, turn the light on independently of the fan and vice versa, turn both on simultaneously, and turn both off. In certain embodiments of the device 100 with a variable speed fan 105, the switch 102 can control the different speeds of the fan (e.g., with an adjustable resistor or other rheostat). In some embodiments, a multi-function switch can allow a user to turn on the light, turn on the light and fan in a low speed, turn on the light and fan in a high speed, and turn on the lights such that they flash or blink. In some embodiments, the light source 103 can be dimmable and a dimming function can be incorporated into the switch 102 or as a separate control. In certain embodiments, a multi-function switch 102 can provide a user with controls including, but not limited to, turning on an emergency blinker, variable fan speed, variable light output, battery status indicator, and electronic speed control.

In the illustrated embodiments, one or more batteries 101 carried by the hand enclosure 106 provide the necessary power to the light source 103 and fan 105. The batteries 101 can be replaceable and/or rechargeable (e.g., with solar panel, a household charger, usb charger, and/or an integrated hand crank power generator (e.g., turbine/dynamo). The hand crank power generator can have the ability to also charge peripheral devices via a charging port connector. In other embodiments, other suitable or compatible power sources can be used to provide power to the light source 103 and fan 105 including super capacitors, fuel cells, solar energy, etc. Also, in certain embodiments, the handle enclosure 106 may incorporate other safety, survival equipment such as, for example, a radio, a global positioning system tracking system, a compass, or the like.

From the foregoing, it will be appreciated that specific embodiments have been described herein for purposes of illustration, but that modifications may be made without deviating from the spirit and scope of the various embodiments of the present technology. The hand-held device 100 illustrated in FIGS. 1A-1D can include, for example, additional components operably coupled to the hand enclosure 106 including an integrally formed or separately attached radio, global positioning unit (e.g., gps), hand-crank power generator, lanyard or carabiner ring, whistle, illuminated compass, and/or waterproof recharging port. In some embodiments, while vented ducting 104 with a generally conical-shaped configuration is illustrated, different suitable shapes can be used (e.g., cylindrical, rectangular). As described above, in certain embodiments, the components of the device 100 are integrally formed while in other embodiments, the components are separately assembled and coupled to each other. In other embodiments, kits can be sold including one or more of any of the components, such that any of the features described herein can be retrofitted onto or with (e.g., an existing flashlight). Specific elements of any of the foregoing embodiments can also be omitted and/or combined or substituted for elements in other embodiments. Furthermore, while advantages associated with certain embodiments of the present technology have been described in the context of these embodiments, other embodiments may also exhibit such advantages, and not all embodiments need necessarily exhibit such advantages to fall within the scope of the technology. Accordingly, the present technology is not limited, except as by the appended claims.

I claim:

1. A multipurpose hand-held device for providing light and airflow comprising:

a handle enclosure having a proximal end and a distal end;

a frustoconical, vented ducting, having one or more vents and extending from the distal end of the handle enclosure, wherein an electric fan is mounted within the vented ducting, wherein the frustoconical, vented ducting comprising a first opening proximal the distal end of the handle and a second opening distal from the distal end of the handle, the first opening have a greater area than the second opening such that the frustoconical, vented ducting converges from the first opening to the second opening and the fan is configured to provide airflow from the one or more vents to the second opening;

a light source mounted proximate the first opening of the ducting;

a power source; and, a switch, wherein the electric fan and the light source are operably coupled to the power source and the switch such that a user can turn on the fan and light source as desired.

2. The multipurpose hand-held device of claim 1, wherein the handle enclosure, power source, and light source are components of a flashlight.

3. The multipurpose hand-held device of claim 2, wherein the handle enclosure includes an adjustable tripod stabilizer.

4. The multipurpose hand-held device of claim 1, wherein the vented ducting includes one or more vents positioned upstream of the fan for providing intake air to the fan.

5. The multipurpose hand-held device of claim 4, wherein the ducting includes one or more vents having a protective screen mesh configured to prevent debris from entering the ducting.

6. The multipurpose hand-held device of claim 5, wherein the vented ducting is made with a photo-luminescent material.

7. The multipurpose hand-held device of claim 4, wherein the light source is positioned downstream of the fan.

8. The multipurpose hand-held device of claim 1, wherein the handle enclosure includes a storage compartment.

9. The multipurpose hand-held device of claim 1, wherein the power source includes one or more batteries.

10. The multipurpose hand-held device of claim 1, wherein the light source includes one or more LEDs.

11. The multipurpose hand-held device of claim 1, wherein the electric fan comprises a motor with electronic speed control.

12. The multipurpose hand-held device of claim 1, wherein the switch is a multi-function switch configured to control at least one of variable fan speed, variable light output, battery status indicator, and an emergency blinker.

13. The multipurpose hand-held device of claim 1, wherein the fan is configured to provide an airflow between about 2 and 6 liters per second.

14. The multipurpose hand-held device of claim 1, wherein the switch is a multi-function switch configured to have at least four positions, wherein in a first position power is provided to the light source, in a second position power is provided to the light source and controls the fan to operate at a first speed, in a third position power is provided to the light source and controls the fan to operate at a second speed different from the first, and in a fourth position the light source is controlled to flash.

15. The multipurpose hand-held device of claim 1, wherein an internal surface of the vented ducting is mirrored.

16. The multipurpose hand-held device of claim 1, further comprising a turbine/dynamo and a hand crank to provide power.

17. A method for assembling a multipurpose hand-held device for providing airflow and light, the method comprising:

providing a handle having a proximal end and a distal end wherein the handle includes a light source at the distal end;

mounting a duct to a distal end of a handle, the duct having one or more vents downstream of a distal end of the handle, wherein the duct comprises a frustoconical shape having a first opening proximal the distal end of the handle and a second opening distal from the distal end of the handle, the first opening have a greater area than the second opening such that the frustoconical, vented ducting converges from the first opening to the second opening and wherein the light source is mounted within the ducting;

mounting a fan within the duct downstream of the one or more vents, wherein the fan is configured to provide airflow from the one or more vents to the second opening;

electrically coupling the fan and a light source to a power source and a switch for operating the fan and the light source to provide airflow and light.

18. The method of claim 17, wherein the fan can be operated independently of the light source.

19. The method of claim 17, wherein the light source is positioned downstream of the fan.

20. The method of claim 17, wherein a speed of the fan or an output of the light source can be varied using the switch.

* * * * *